United States Patent [19]

Phillips

[11] Patent Number: 4,686,911

[45] Date of Patent: Aug. 18, 1987

[54] BLAST SUPPRESSION DEVICE

[75] Inventor: Thomas Phillips, Canfield, Ohio

[73] Assignee: DTS, Inc., Youngstown, Ohio

[21] Appl. No.: 848,246

[22] Filed: Apr. 4, 1986

[51] Int. Cl.[4] ..... E05G 3/00; E04H 9/00

[52] U.S. Cl. ..... 109/1 S; 109/27; 52/1; 52/86

[58] Field of Search ..... 109/1 S, 26–28, 109/81, 49.5; 52/1, 86, 169.6

[56] References Cited

U.S. PATENT DOCUMENTS

| | | | |
|---|---|---|---|
| 40,213 | 10/1863 | Jamain | 109/1 S |
| 2,816,329 | 12/1957 | Sogaro | 52/86 |
| 4,091,584 | 5/1978 | Brown | 52/86 |
| 4,327,241 | 4/1982 | Obenchain | 52/1 |

FOREIGN PATENT DOCUMENTS

| | | | |
|---|---|---|---|
| 153644 | 9/1985 | European Pat. Off. | 52/1 |

*Primary Examiner*—Gary L. Smith
*Assistant Examiner*—Neill Wilson
*Attorney, Agent, or Firm*—Harpman & Harpman

[57] ABSTRACT

A blast supression device for use in explosive hardening in a relatively confined enclosed area. The device absorbs and dissipates the explosive force by utilizing a containment frame covered with overlapping multiple flexible resilient flaps that dissipate the explosive force by yielding during the blast within the device.

3 Claims, 5 Drawing Figures

BLAST SUPPRESSION DEVICE

BACKGROUND OF THE INVENTION

1. Technical Field

This device relates to blast suppression enclosures that limit or confine the blast effects for safety and health reasons.

2. Description of the Prior Art

Prior art devices of this type have relied on a variety of different structural enclosures to limit blast effects. See for example U.S. Pat. Nos. 4,325,309, 4,248,342 and 3,800,715.

In U.S. Pat. No. 4,325,309, a device is disclosed that comprises a shield system having multiple paneled configurations of alternate layers of steel grating, steel perforated plates and steel louvered panels or wire screening. The shield reduces blast over pressure and heat and will contain flying debris.

U.S. Pat. No. 4,248,342 discloses an improved version of the shield system that was disclosed in U.S. Pat. No. 4,325,309 having almost an identical structural configuration.

In U.S. Pat. No. 3,800,715, a bomb recovery shield apparatus is shown having a support cage covered with rigid high strength material, such as steel, with the ends of the enclosure being open and covered with mesh and a lid to help suppress the blast force directed outwardly from the ends.

SUMMARY OF THE INVENTION

A blast suppression device for use in a confined area provides a yielding structure to absorb and dissipate the blast effects without damage to itself for repeated reuse. The device consists of a rigid support frame with multiple flexible panels movably secured thereto. The device is buried in sand or the like to stabilize and restrict movement of the flexible panels under the force of the blast.

DESCRIPTION OF THE PREFERRED EMBODIMENT

Figure 1:
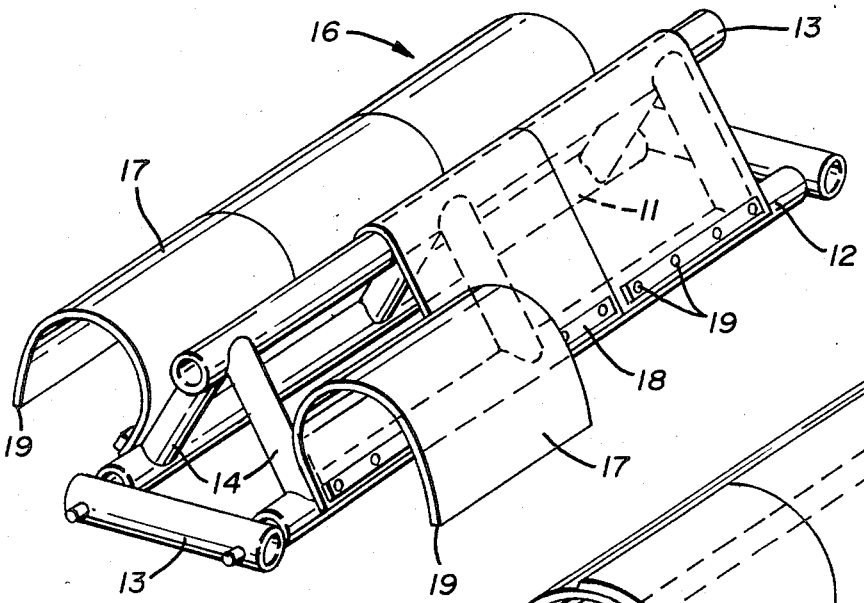
FIG. 1 is a perspective view of the blast suppression device.

A blast suppression device for use with explosive hardening techniques that comprises a support frame 10 having a pair of base support tubular members 11 and 12 in spaced parallel relation to one another.

An upper support tubular member 13 is vertically spaced between said support tubular members. Pairs of longitudinally angularly aligned oppositely disposed interconnection member 14 extend between said upper support member 13 and said base support tubular members 11 and 12 respectively forming a generally elongated triangular frame configuration.

An end base tubular connection member 15 is positioned on either end of said support frame 10 removably secured between the free ends of said base support tubular members 11 and 12. A plurality of resilient flap configurations 16 comprised of individual flaps 17, each secured to the base support tubular members 11 and 12 by attachment bars 18 and fasteners F as will be well understood by those skilled in the art.

The resilient flap configurations 16 have a plurality of flaps located on either side of the elongated triangular frame configuration in side to side abutting relationship. Each pair of oppositely disposed flaps 17 overlap their respective free ends 19 on one another equally across the upper support tubular member 13 forming a tent-like enclosure resilient and yieldable in nature.

Figure 2:
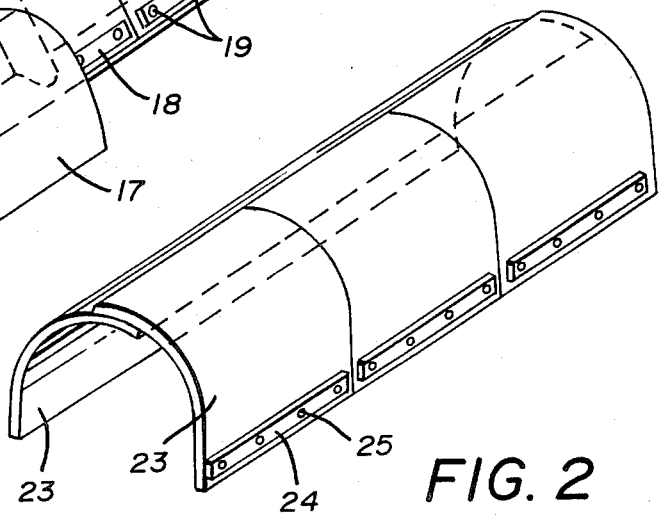
FIG. 2 is a perspective view of flexible flaps removed from the device.
Figure 3:
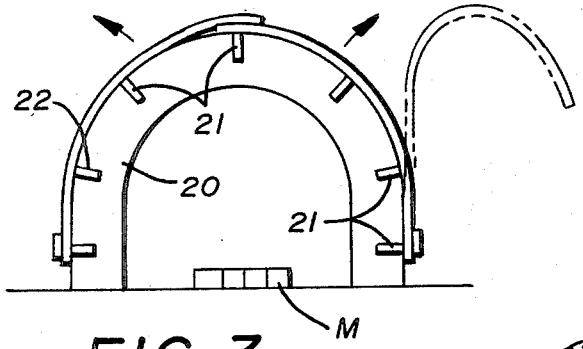
FIG. 3 is an alternate form of the invention.
Figure 4:
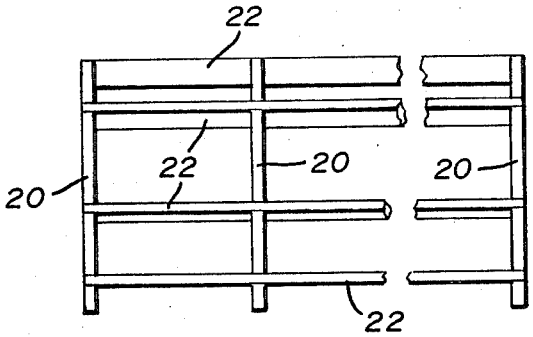
FIG. 4 is a side elevation of the alternate form of the invention seen in FIG. 3.
Figure 5:
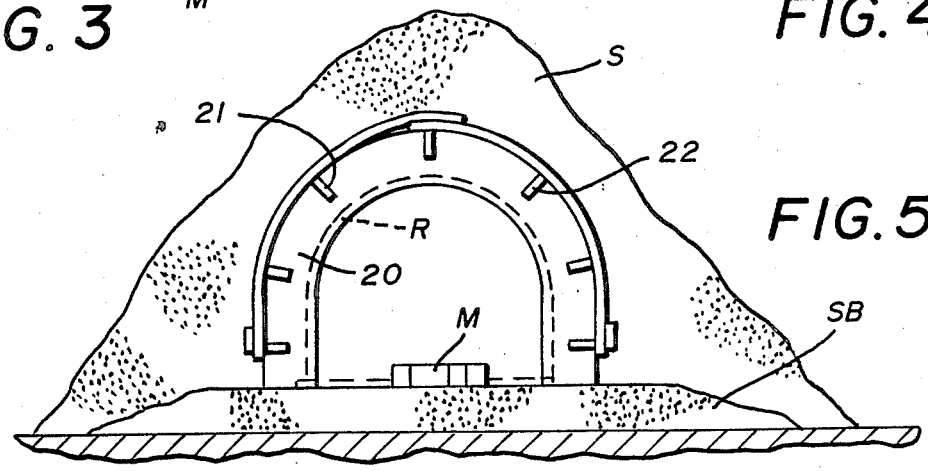
FIG. 5 is an end view of the alternate form of the blast suppression device buried in sand as it would be used.

Referring to FIGS. 2,3 and 4 of the drawings, an alternate form of the invention is disclosed having a plurality of arcuate upstanding plates 20 aligned longitudinally in spaced relation to one another. Each of the plates 20 has a series of radially spaced notches 21 in its outermost edge to receive longitudinally extending interconnecting fastner bands 22 defining a ribbed enclosure 23A. Pairs of oppositely disposed resilient rubber flaps 23 are secured to the lowermost band 22 at 21 by a support plate 24 and multiple fasteners 25. The flaps 23 abut one another in side to side relationship as seen in FIG. 2 of the drawings overlapping their free ends of the oppositvely disposed flap pairs on the ribbed enclosure 23A. The arcuate upstanding plates 20 provide a stable frame for the interconnecting bands 22 and expose only a small edge surface area to the blast force improving durability and reuse factors.

In operation, the blast suppression device is positioned directly over the material to be hardened (M) on a bed of sand (SB). The material to be hardened (M) has been prepared with appropriately placed and configured blasting charges (not shown) positioned as will be well understood by those skilled in the art of blast hardening. The multiple flaps 23 are overlapped on the structure as hereinbefore described. End retainers (R) shown in broken lines in FIG. 4 of the drawings are secured to either end of the support frame. The end retainers (R) can be of any one of a variety of different materials and are used solely to prevent the filling in or the enclosure ends by sand (S) that is used to cover the entire structure to a depth of approximately three to four feet.

Once the blasting charges are fired, the resulting blast force is confined within the blast suppression device which absorbs and dissipates the blast force by flanging back the flaps 17 and 23 under the weight of the sand S.

This unique flexible absorbent action allows such blast hardening to be used in an indoor relatively confined space, unlike blast hardening methods used heretofore that require a large outdoor blast area consisting of many acres.

After the blast, the blast suppression device is removed and reused in tact with only the addition of new end retainers (R).

It will be evident from the above description that the principal object of the invention is to contain and dissipate blast force in a reuseable structure which is most desirable in the blast hardening techniques of metal articles, such as railroad frogs. The ability to contain and dissipate the blast allows use of the blast hardening in confined areas such as indoors where it was heretofore impossible to do allowing blasting on site of production greatly reducing the cost and time consuming factors of shipping material to a blast site.

It will thus be seen that a new and useful blast suppression device has been illustrated and described and that various changes and modifications may be made herein without departing from the spirit of the invention and having thus described my invention, what I claim is:

1. A blast supression device for use in a confined area comprises a multiple segmented support frame, said frame having a plurality of inner-connected members secured in space relation to one another, on said multiple segments, said frame defining an elongated enclosure opened on its lower portion, a plurality of oppositely disposed flexible resilient flaps secured on one end to said support frame in side to side relation and overlapping each other on their respective free ends, end restraints removably positioned in oppositely disposed relation to one another on the open ends of said support frame.

2. A blast supression device of claim 1 wherein said multiple segments of said support frame comprise arcuate members aligned in spaced parallel relation to one another.

3. A blast supression device for use in a confined area comprises in combination a multiple segmented support frame, said frame having a plurality of inner-connected members secured in spaced relation to one another, said frame defining an elongated enclosure apertured at its lower portion, a plurality of oppositely disposed flexible resilient flaps secured on one end of said support frame in side to side relation and overlapping each other on their respective free ends, end restraints removably positioned in oppositely disposed relation to one another on the open ends of said support frame, said blast supression device covered to a pre-determined depth by a flowable particulate material to provide a yielding mass on said oppositely disposed flexible flaps and said end restraints.

* * * * *